US011122885B2

(12) United States Patent
Jimenez

(10) Patent No.: US 11,122,885 B2
(45) Date of Patent: Sep. 21, 2021

(54) ORAL CARE IMPLEMENT

(71) Applicant: Colgate-Palmolive Company, New York, NY (US)

(72) Inventor: Eduardo Jimenez, Manalapan, NJ (US)

(73) Assignee: Colgate-Palmolive Company, New York, NY (US)

( * ) Notice: Subject to any disclaimer, the term of this patent is extended or adjusted under 35 U.S.C. 154(b) by 252 days.

(21) Appl. No.: 16/386,338

(22) Filed: Apr. 17, 2019

(65) Prior Publication Data

US 2019/0239634 A1 Aug. 8, 2019

Related U.S. Application Data

(63) Continuation of application No. 15/807,852, filed on Nov. 9, 2017, now Pat. No. 10,306,975, which is a
(Continued)

(51) Int. Cl.
*A46B 15/00* (2006.01)
*A46B 5/02* (2006.01)
(Continued)

(52) U.S. Cl.
CPC ..... *A46B 15/0097* (2013.01); *A46B 5/0033* (2013.01); *A46B 5/023* (2013.01);
(Continued)

(58) Field of Classification Search
CPC ..... A46B 15/0097; A46B 5/0033; A46B 9/04; A46B 2200/1066; A46B 5/023; A46B 15/0089; A46B 15/0087
See application file for complete search history.

(56) References Cited

U.S. PATENT DOCUMENTS

D172,497 S 6/1954 Fischer
3,302,230 A 2/1967 Poppelmann
(Continued)

FOREIGN PATENT DOCUMENTS

CN 203505894 4/2014
EP 1611818 B1 10/2018
(Continued)

OTHER PUBLICATIONS

International Search Report and Written Opinion of the International Searching Authority in International Application No. PCT/US2018035254, dated Sep. 27, 2018.
(Continued)

*Primary Examiner* — Shay Karls

(57) ABSTRACT

An oral care implement includes a head portion. The head portion includes one or more tooth cleaning elements. The oral care implement includes a handle portion that may be coupled to the head portion. The handle portion includes a central body having a proximal portion. The proximal portion may be opposite the head portion. The handle portion may include a first appendage extending laterally outwards from a first side of the central body in a first direction and a second appendage extending laterally outwards from a second side of the central body in a second direction opposite to the first direction. The first and second appendages may be angled towards each other to form an obtuse angle therebetween (e.g., when in an unstressed state). The proximal portion of the central body may protrude from a bottom end of the first and second appendages.

18 Claims, 11 Drawing Sheets

Related U.S. Application Data continuation-in-part of application No. 29/606,133, filed on Jun. 1, 2017, now Pat. No. Des. 828,037, which is a continuation-in-part of application No. 29/606,137, filed on Jun. 1, 2017, now Pat. No. Des. 826,569, which is a continuation-in-part of application No. 29/606,140, filed on Jun. 1, 2017, now Pat. No. Des. 826,570.

(51) Int. Cl.
*A46B 5/00* (2006.01)
*A46B 9/04* (2006.01)

(52) U.S. Cl.
CPC ..... *A46B 9/04* (2013.01); *A46B 15/0087* (2013.01); *A46B 15/0089* (2013.01); *A46B 2200/1066* (2013.01)

(56) References Cited

U.S. PATENT DOCUMENTS

| | | | | |
|---|---|---|---|---|
| D208,638 | S | 9/1967 | Strauss | |
| 3,753,266 | A | 8/1973 | Ceniceros | A46B 9/04 15/110 |
| D229,903 | S | 1/1974 | Ceniceros | |
| 4,221,822 | A | 9/1980 | Horn et al. | |
| D265,698 | S | 8/1982 | Roth | |
| 4,454,632 | A | 6/1984 | Nix et al. | |
| D276,637 | S | 12/1984 | Paczko | |
| 4,654,921 | A | 4/1987 | Dinner | |
| 4,780,924 | A | 11/1988 | Hansen | A46B 5/02 15/145 |
| 5,048,143 | A | 9/1991 | Carroll | |
| 5,138,737 | A | 8/1992 | Thomas | |
| D333,216 | S | 2/1993 | Bruns et al. | |
| 5,187,829 | A | 2/1993 | Atkins | |
| D360,984 | S | 8/1995 | Sullivan, IV | |
| 5,571,140 | A | 11/1996 | Gura-Emerling | |
| 5,623,739 | A | 4/1997 | Thompson | |
| D383,307 | S | 9/1997 | Klein et al. | |
| D388,615 | S | 1/1998 | Phillips | |
| D391,643 | S | 3/1998 | Fletcher | |
| D391,644 | S | 3/1998 | Fletcher | |
| 5,774,921 | A | 7/1998 | Harrison et al. | |
| D404,921 | S | 2/1999 | Smith | |
| D414,216 | S | 9/1999 | Crain, Jr. et al. | |
| 6,015,328 | A * | 1/2000 | Glaser | A46B 5/02 15/167.1 |
| D420,803 | S | 2/2000 | Pedro, Jr. et al. | |
| D421,185 | S | 2/2000 | Remme | |
| 6,116,191 | A | 9/2000 | Suchowski et al. | |
| 6,295,686 | B1 | 10/2001 | Phillips | |
| D456,136 | S | 4/2002 | Roehrig | |
| D462,773 | S | 9/2002 | Viana | |
| 6,461,164 | B1 | 10/2002 | Ramelli | |
| D555,844 | S | 11/2007 | Dennis | |
| D566,400 | S | 4/2008 | Phillips | |
| D569,077 | S | 5/2008 | Axelrod | |
| D619,370 | S * | 7/2010 | Tegeder | D4/107 |
| D684,746 | S | 6/2013 | Pang et al. | |
| D688,046 | S | 8/2013 | Aslett et al. | |
| D721,439 | S | 1/2015 | Swartz | |
| D745,283 | S | 12/2015 | Phillips et al. | |
| 9,480,626 | B2 | 11/2016 | Rohrig | A61J 17/02 |
| D778,616 | S | 2/2017 | Tegeder et al. | |
| 10,306,975 | B2 | 6/2019 | Jimenez | |
| 2002/0112302 | A1 | 8/2002 | Harrison et al. | |
| 2004/0200748 | A1 | 10/2004 | Klassen | |
| 2005/0004603 | A1 | 1/2005 | Desousa | |
| 2005/0271997 | A1 | 12/2005 | Mikami | |
| 2008/0311282 | A1 | 12/2008 | Hammon | |
| 2009/0130945 | A1 | 5/2009 | Moss | |
| 2009/0144921 | A1 | 6/2009 | Newsome | |
| 2010/0136874 | A1 | 6/2010 | Moss | |
| 2010/0319149 | A1 | 12/2010 | Phillips | |
| 2015/0305483 | A1 | 10/2015 | Miller et al. | |
| 2017/0013953 | A1 | 1/2017 | Tegeder et al. | |

FOREIGN PATENT DOCUMENTS

| | | |
|---|---|---|
| KR | 20150106554 | 9/2015 |
| WO | 2018/020229 | 2/2018 |
| WO | 2018/222786 | 12/2018 |

OTHER PUBLICATIONS

Windridge, 2016, "Matchstick Monkey—Baby Teether // Training Toothbrush by Katie—Kickstarter," http://www.kickstarter.com/projects/1152143952/matchstick-monkey-teething-gel-applicator.

Baby Banana Brush with Handle by Live-Right LLC, Creative Child, https://www.creativechild.com/products/view/baby-banana-brush-with-handle dowloaded from the Internet on Oct. 16, 2017, 3 pages.

The Cornelius Teether from Baby Banana Brush [Viewed on Internet on Mar. 9, 2021] < URL: https://www.youtube.com/watch?v=rZdZpqqp97g>, Published on Oct. 31, 2016, Whole document.

* cited by examiner

ORAL CARE IMPLEMENT

CROSS-REFERENCE TO RELATED PATENT APPLICATIONS

The present application is a continuation of U.S. patent application Ser. No. 15/807,852, filed on Nov. 9, 2017, which is a continuation-in-part of: (1) U.S. patent application Ser. No. 29/606,133, filed on Jun. 1, 2017, now U.S. Pat. No. D828,037; (2) U.S. patent application Ser. No. 29/606,140, filed on Jun. 1, 2017, now U.S. Pat. No. D826,570; (3) U.S. patent application Ser. No. 29/606,137, filed on Jun. 1, 2017, now U.S. Pat. No. D826,569, the entireties of which are incorporated herein by reference.

BACKGROUND

The present invention relates to oral care systems, and particularly to an oral care implement suitable for use with infants or toddlers.

Oral care implements such as toothbrushes are susceptible to bacterial contamination resulting from normal use and handling. Bacterial accumulations may be especially prevalent on the head portion of the toothbrush, particularly within the tooth cleaning elements such as bristles and/or elastomeric cleaning elements. The bacteria can contribute to tooth decay and gum disease. Bacterial contamination of the toothbrush head which poses a general health risk is also a concern considering the head is placed in the oral cavity. Such contamination may be transferred from various hard surfaces on which the toothbrush might be placed or accidentally dropped. It is desirable therefore to minimize bacterial contamination from various environmental sources.

It is further desirable to construct a toothbrush for use with babies (infants or toddlers) that is soft and pliable to prevent injury, and yet still be configured to prevent over-insertion into the oral cavity which could pose a potential choking hazard.

BRIEF SUMMARY

The present invention provides an oral care implement for use with infants and toddlers which meet the foregoing goals. The oral care implement may be a toothbrush having a resiliently deformable construction. The toothbrush may be configured to minimize or prevent contact between the head and bacterially-contaminated flat hard surfaces when dropped or placed thereon such as a countertop or floor, thereby forming a system that helps maintain the sterility of the toothbrush head. In one implementation, the toothbrush may have resiliently foldable appendages, which when in an outward unfolded position, create a wide lateral profile to prevent over-insertion of the toothbrush into the oral cavity of the infant or toddler. When used by an adult to brush the infant's or toddler's teeth, the appendages may be folded inward to a collapsed position to reduce the lateral profile for better access to tooth surfaces deeper in the mouth or oral cavity.

In an aspect, an oral care implement includes a head portion. The head portion may include one or more tooth cleaning elements. The oral care implement may include a handle portion that is coupled to the head portion. The handle portion may include a central body having a proximal portion. The proximal portion may be opposite the head portion. The handle portion may include a first appendage extending laterally outwards from a first side of the central body in a first direction and a second appendage extending laterally outwards from a second side of the central body in a second direction opposite to the first direction. The first and second appendages may be angled towards each other to form an obtuse angle therebetween (e.g., when in an unstressed state). The proximal portion of the central body may protrude from a bottom end of the first and second appendages.

In another aspect, an oral care implement may include a head portion that may include one or more tooth cleaning elements. The oral care implement may include a handle portion that is coupled to the head portion. The handle portion may include a central body. The handle portion may include a front side having a first point of contact to a surface and a second point of contact to the surface. The first and second points of contact may define a front support plane that is coplanar with the surface. The handle portion may include a contoured portion separating the first and second points of contact. The front support plane may not intersect the contoured portion. The handle portion may include a first appendage extending outwards from a first lateral side of the central body in a first direction and a second appendage extending outwards from a second lateral side of the central body in a second direction.

In another aspect, an oral care implement may include a head portion that may include one more tooth cleaning elements. The oral care implement may include a handle portion coupled to the head portion. The handle portion may include a central body having a bulbous spherically shaped distal portion and an arch shaped proximate portion. The bulbous spherically shaped distal portion and the arch shaped proximate portion may define a respective first point of contact to a surface and a second point of contact to the surface. The first and second points of contact may define a front support plane that is coplanar with the surface. The handle portion may include a first appendage extending outwards from a first lateral side of the central body in a first direction and a second appendage extending outwards from a second lateral side of the central body in a second direction.

In another aspect, an oral care implement comprises: a longitudinal axis; a head portion comprising a plurality of tooth cleaning elements; a handle portion supporting to the head portion, the handle portion comprising: a central body; a first appendage extending outwards from a first lateral side of the central body in a first direction; and a second appendage extending outwards from a second lateral side of the central body in a second direction opposite to the first direction; wherein the first and second appendages are each foldable over and against a rear side of the central body.

In another aspect, an oral care implement comprises: a longitudinal axis; a head portion comprising a plurality of tooth cleaning elements; a handle portion supporting the head portion; a front side of the handle portion defining at least one front contact zone, the front contact zone defining a front support plane; a rear side of the handle portion defining a plurality of rear contact zones, the rear contact zones defining a rear support plane; wherein the front and rear support planes do not intersect the head portion.

In another aspect, an oral care implement comprises: a longitudinal axis; a head portion comprising a plurality of tooth cleaning element; a handle portion supporting the head portion; a first appendage extending laterally outwards from a first side of the handle portion in a first direction; and a second appendage laterally outwards from a second side of the handle portion in a second direction opposite to the first direction; wherein the first and second appendages are angled towards each other to form an obtuse angle therebetween.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

Figure 1:
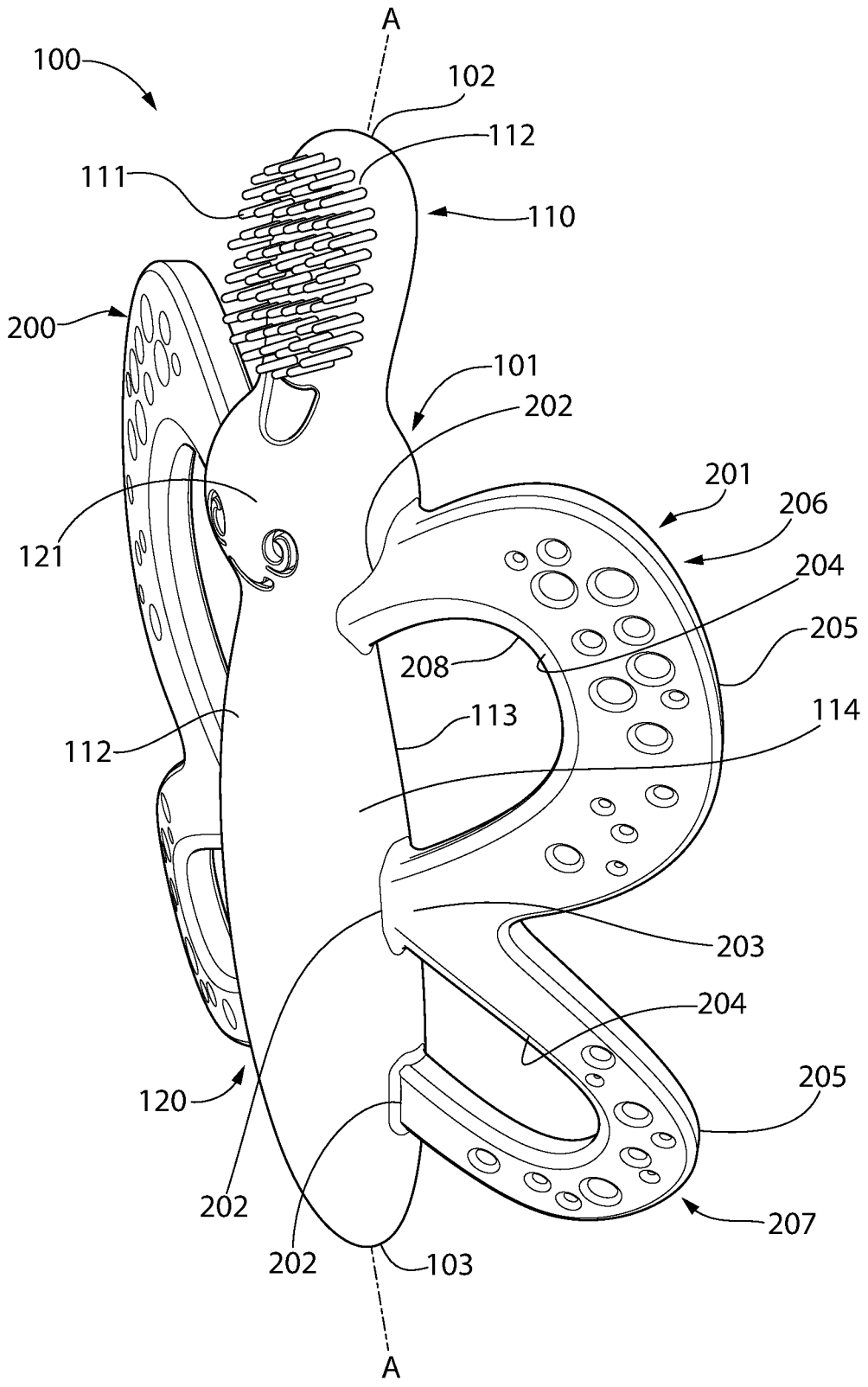
FIG. 1 is a front perspective view of an oral care implement according to one embodiment of the present invention in the form of a toothbrush generally including a head portion and handle portion having a central body and foldable appendages shown in an unfolded position.
Figure 2:
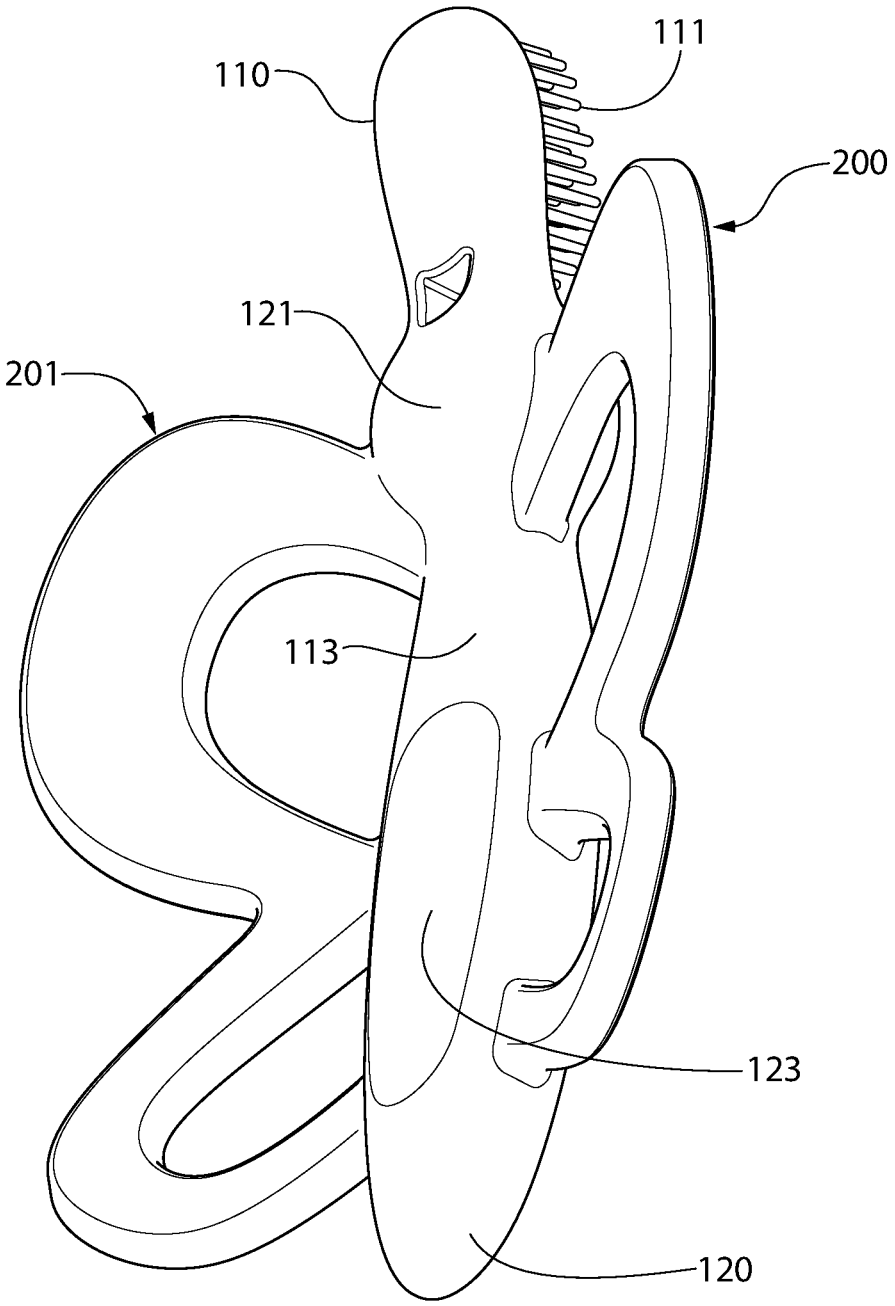
FIG. 2 is a rear perspective view thereof.

All drawing are schematic and not necessarily to scale.

DETAILED DESCRIPTION

The following description of the preferred embodiment(s) is merely exemplary in nature and is in no way intended to limit the invention, its application, or uses.

In the description of embodiments disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Referring generally to FIGS. 1-12, an oral care implement according to the present disclosure may be a toothbrush 100 in one non-limiting embodiment. Toothbrush 100 generally includes a longitudinal axis A-A, distal head portion 110 defining a distal end, and a longitudinally elongated proximal handle portion 101 supporting the head portion and defining a proximal end 103. The handle portion 101 comprises a central body and pair of resiliently foldable appendages extending laterally outwards therefrom in opposite directions. In one embodiment, the appendages may be wings 200, 201 wherein the term "wings" is expressly used in a broad structural sense only and not in a context necessarily associated with any animate object. The central body extends from proximal end 103 of the toothbrush 100 to the head portion 110 along longitudinal axis A-A. The toothbrush 100 further includes a front side 112, opposing rear side 113, and pair of opposing lateral sides 114 extending between the front and rear sides and from the proximal end 103 to distal end 102. The longitudinal axis A-A follows the contours and shapes of the toothbrush from proximal to distal ends 103, 102 and remains at the centerline of each transverse section of the toothbrush through which the longitudinal axis extends. Accordingly, the longitudinal axis A-A is not necessarily a straight reference line in all cases depending on the shape and curvature of the toothbrush body. In one embodiment, the central body of handle portion 101 may be arcuately curved from proximal end 103 to distal end 102 forming a substantially convex front side 112 and concave rear side 113 from end to end. Longitudinal axis A-A accordingly has a complementary arcuate shape.

The central body of the handle portion 101 further defines an upper distal portion 121 adjoining the head portion 110 of the toothbrush 100 and a lower proximal portion 120. In one embodiment, a reduced cross section transition or neck section 122 is formed between the distal portion 121 of handle portion 101 and proximal portion 120 and has a smaller lateral width (measured transversely to longitudinal axis A-A) than the adjoining portions of the proximal or distal portions. The proximal portion 120 is elongated in configuration and may have a longitudinal length that comprises a majority of the length of the central body. By contrast, distal portion 121 may be a bulbous and diametrically enlarged, thereby defining a generally round structure of approximately spherical configuration (see, e.g. FIGS. 3 and 4). Distal portion 121 may have a greater lateral width (measured transversely to longitudinal axis A-A between lateral sides 114) than head portion 110 or proximal portion 120, and in some embodiments a greater depth or thickness as well (measured transversely to longitudinal axis A-A between front and rear sides 112 and 113). The distal portion 121 may therefore protrude outwards beyond the front and rear sides 112, 113 of the proximal portion 120 to raise/ elevate the head portion off a hard flat horizontal surface when placed thereon, as further described herein.

Toothbrush 100 including head portion 110, handle portion 101, and wings 200, 201 may be formed as a single monolithic unitary structure made of a resiliently flexible and deformable material having an elastic memory. In one embodiment, the toothbrush 100 may be made of silicone rubber having an optimal durometer hardness value of at least 60. Lower durometer materials are generally too soft and flexible to maintain a certain degree of rigidity desired for the wings 200, 201 to maintain their shape and support the central body of handle portion 101 when the toothbrush is placed on a flat horizontal surface, for purposes to be further described herein. In one embodiment, the material may have a durometer hardness value in a range between and including 60-70, which provides a hardness that provides sufficient rigidity to the wings, yet is soft and flexible enough for use with infants or toddlers to prevent injury. Any suitable process may be used to fabricate toothbrush 100. In one embodiment, the toothbrush may be made by Liquid Silicone Molding (LSM) or alternatively compression molding. Other processes may be used.

Head portion 110 of toothbrush 100 may be elongated having a greater longitudinal length than lateral width. The front side 112 of the head portion 110 may be substantially planar in one embodiment and comprises a plurality of tooth cleaning elements 111 extending transversely outwards from the front side 112. The exact types, structure, pattern, orientation and material of the tooth cleaning elements 111 is not limiting of the present invention unless so specified in the claims. As used herein, the term "tooth cleaning elements" is used in a generic sense to refer to any structure or combination of structures that can be used to clean, polish or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, spiral bristles, rubber bristles, elastomeric protrusions, flexible polymer protrusions, combinations thereof and/or structures containing such materials or combinations. Suitable elastomeric materials include any biocompatible resilient material suitable for uses in an oral hygiene apparatus. To provide optimum comfort as well as cleaning benefits, the elastomeric material of the tooth or soft tissue engaging elements may have a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

The tooth cleaning elements 111 in the illustrated non-limiting embodiment may be in the form of bristles. The tooth cleaning elements 111 of the present invention can be formed and/or connected to the head portion 110 in any suitable manner now available or to be developed, and is not limiting of the invention. In one embodiment, the tooth cleaning elements 111 may be formed as an integral unitary structural part of the toothbrush head portion 110 during the silicone molding process. In other embodiments, the tooth cleaning elements may be made as separate elements from the toothbrush head portion 110 which are coupled to the head. For example, staples/anchors, in-mold tufting (IMT) or anchor free tufting (AFT) could be used to mount the cleaning elements/tooth engaging elements. In AFT, a plate or membrane is secured to the brush head such as by ultrasonic welding. The bristles extend through the plate or membrane. The free ends of the bristles on one side of the plate or membrane perform the cleaning function. The ends of the bristles on the other side of the plate or membrane are melted together by heat to be anchored in place. Any suitable form of cleaning elements may be used in the broad practice of this invention. Alternatively, the bristles could be mounted to tuft blocks or sections by extending through suitable openings in the tuft blocks so that the base of the bristles is mounted within or below the tuft block.

In certain embodiments, the head portion 110 may also include a soft tissue cleanser (not shown herein) coupled to or positioned on its rear side 113. An example of a suitable soft tissue cleanser that may be used with the present invention and positioned on the rear surface of the head portion 110 is disclosed in U.S. Pat. No. 7,143,462, issued Dec. 5, 2006 to the assignee of the present application, the entirety of which is hereby incorporated by reference. In certain embodiments, the soft tissue cleanser may include a plurality of protuberances, which can take the form of elongated ridges, nubs, or combinations thereof. Of course, the invention is not to be so limited and in certain embodiments the oral care implement 100 may not include any soft tissue cleanser.

With continuing reference to FIGS. 1-12, the proximal portion 120 of handle portion 101 is a longitudinally/axially elongated and oblong structure extending from the proximal end 103 of the central body to the distal portion 121. Proximal portion 120, distal portion 121, and wings 200, 201 provide a primary means for grasping and manipulating the toothbrush 100 during use. The proximal portion 120 may have a somewhat flattened yet circular transverse cross-sectional shape. The front side 112 of the proximal portion 120 may form an arcuately convex surface from side to side. The rear side 113 of proximal portion 120 may have an arcuately convex surface from side to side as well. In one embodiment, the convex rear side may include an elongated flat surface section 123 to facilitate grasping with the fingers or thumb. The proximal portion 120 of handle portion 101 may comprise a majority of the longitudinal length of the handle portion central body, and has a greater length than the head or distal portions 110, 121.

The distal portion 121 of central body of handle portion 101 has a bulbous, diametrically enlarged structure relative to the proximal portion 120 or head portion 110. Distal portion 121 has a generally spherical shape and circular transverse cross-section. Thus, in one embodiment as shown, distal portion 121 may have a diameter and width measured transversely to longitudinal axis A-A between lateral sides 114 that is greater than a width of the handle proximal portion 120. Of course, the invention is not limited to this configuration in all embodiments, and in certain other embodiments the distal portion 121 may not have a greater width than the proximal portion 120. The distal and proximal portions 121, 120 can therefore take on a wide variety of shapes, contours, and configurations; none of which are limiting of the present invention unless so specified in the claims. In one embodiment, distal portion 121 has a greater thickness measured between the front and rear sides 112, 113 of the central body than the adjoining parts of the head portion 110 or proximal portion 120. The distal portion 121 may therefore protrude beyond the adjoining front and rear sides of the proximal portion 120 to elevate the head portion 110 above a flat horizontal surface on which the toothbrush 100 might be rested by a user, as further described herein.

Figure 3:
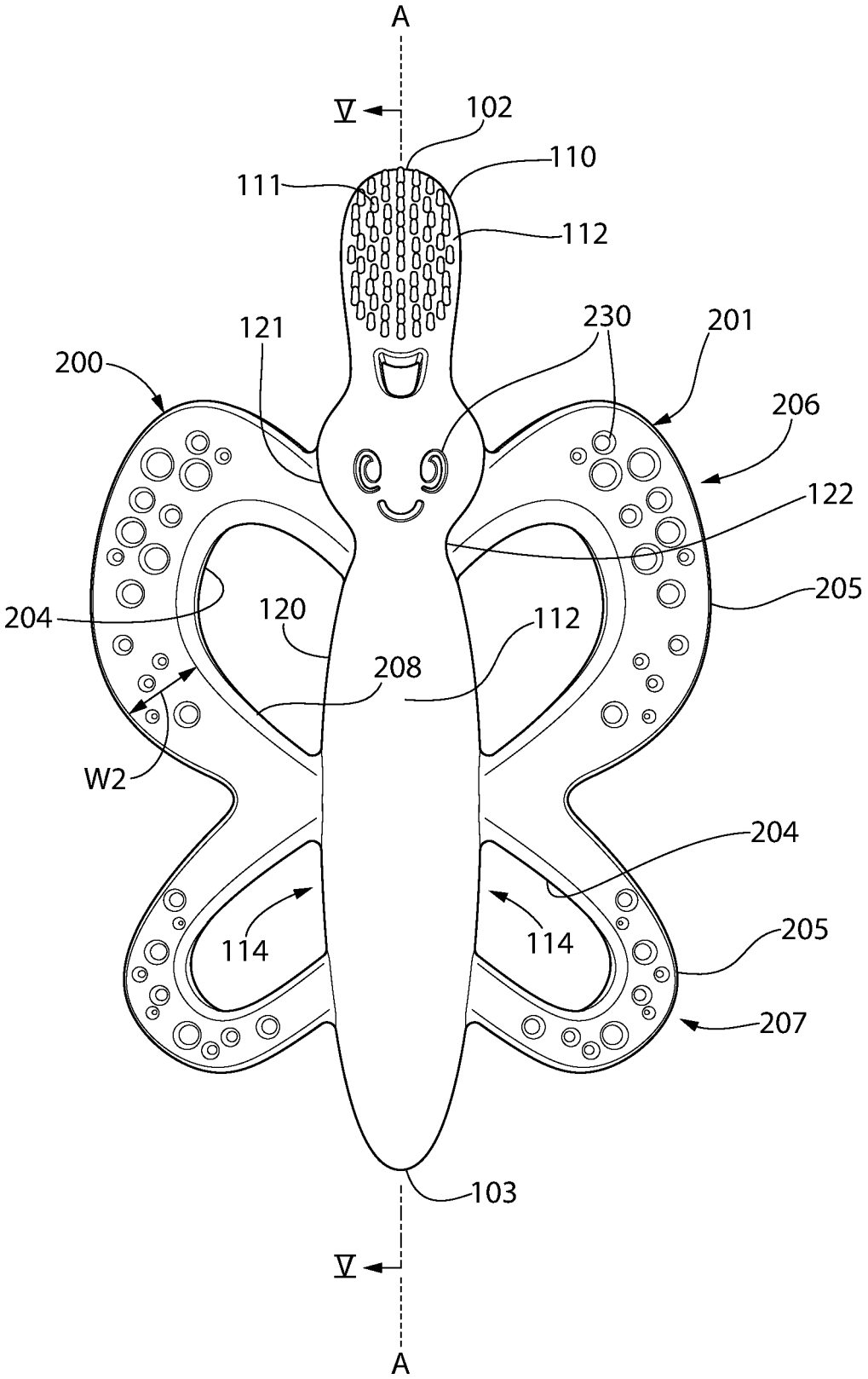
FIG. 3 is a front view thereof.
Figure 4:
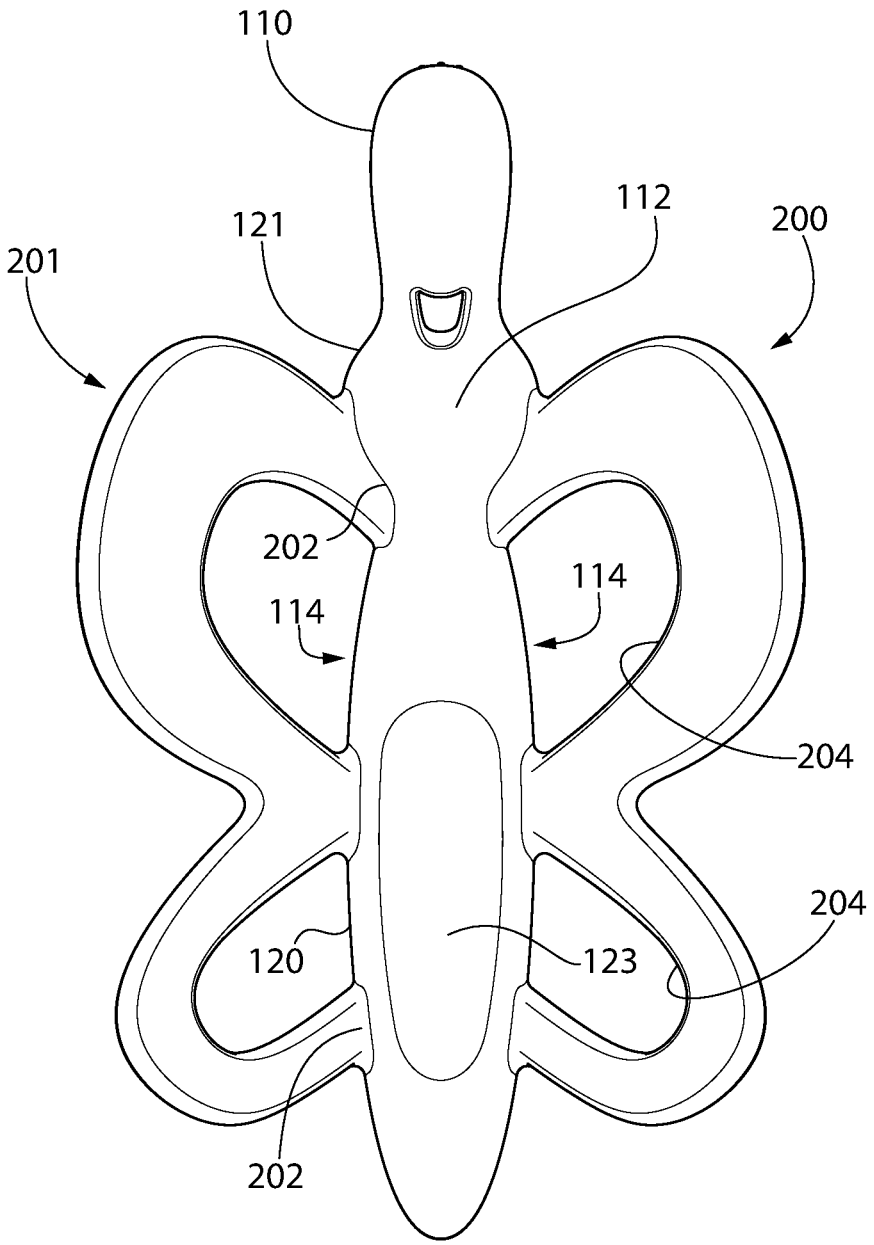
FIG. 4 is a rear view thereof.

The structure and arrangement of the pair of resiliently foldable lateral wings 200, 201 will now be further described with reference to FIGS. 1-12. In one embodiment, wing 200 may be considered a left wing and wing 201 may be considered a right wing for convenience of reference. Wings 200, 201 each comprise at least one recurvant semi-annular loop having opposing fixed ends 202 coupled to the central body of handle portion 101 and exterior arcuate peripheral free edges 205. The peripheral free edges 205 each extend laterally outwards from and between the fixed ends to form an arched structure and profile for each wing (in top plan view as seen in FIG. 3). In the non-limiting illustrated embodiment, each wing 200 and 201 may include a pair of recurvant loops including an upper loop 206 and lower loop 207. In one embodiment, the upper and lower loops 206 and 207 are physically conjoined to form a common end 203 therebetween which is attached to proximal portion 120 of the handle central body as shown. Common end 203 incorporates one of the fixed ends 202 of each loop 206 and 207. This conjoined portion forms a structurally robust common attachment point to the central body. The remaining upper fixed end 202 of upper loop 206 is separately attached to the central body of handle portion 101, such as for example to both proximal portion 120 and distal portion 121 of the central body in one embodiment. This arrangement helps support the narrow transition neck section 122 of the central body of handle portion 101. The remaining lower fixed end 202 of lower loop 207 is also separately attached to the central body, such as for example to proximal portion 120.

In one embodiment, the loops 206 and 207 of each lateral wing 200, 201 are each configured to form a captive opening 204. This provides a convenient opening for grasping the wings during use. Opening 204 defines an interior captive edge 208 opposite the exterior peripheral free edge 205 thereby forming the semi-annular wing loops shown. In other possible less preferred but satisfactory embodiments, the wings may have a solid structure without openings.

Figure 8:
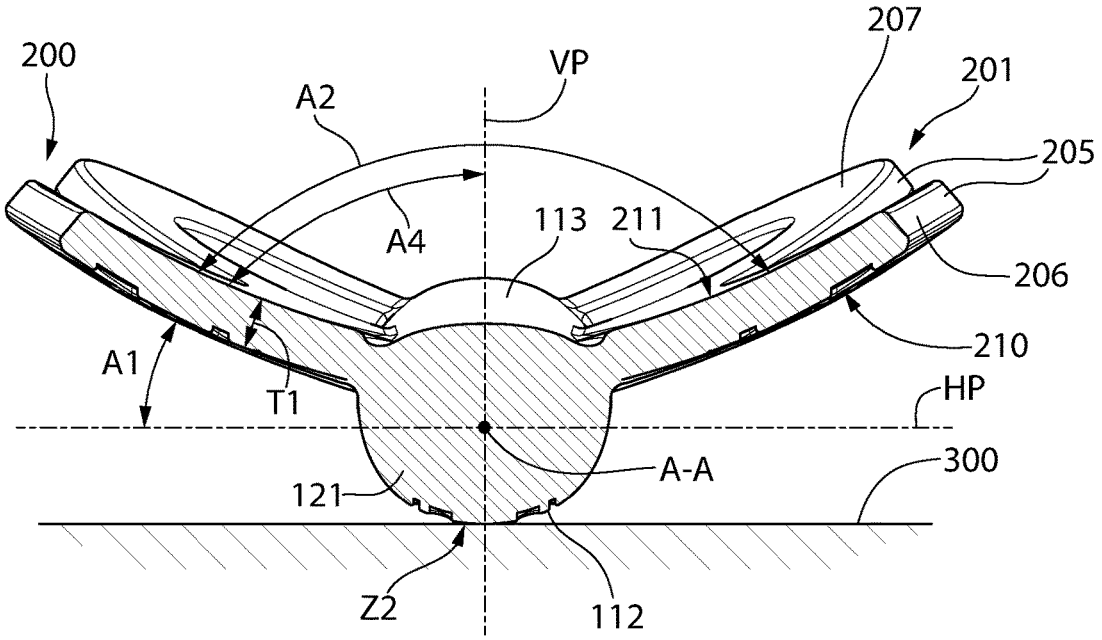
FIG. 8 is a cross-sectional view taken from FIG. 7.
Figure 9:
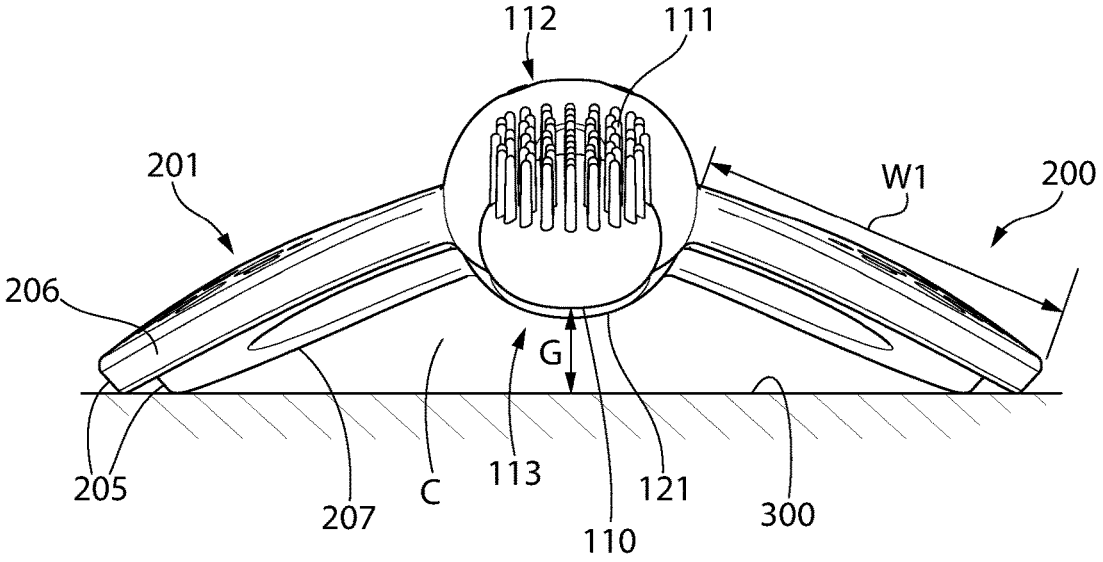
FIG. 9 is a distal end view of the toothbrush shown in FIG. 6.
Figure 10:
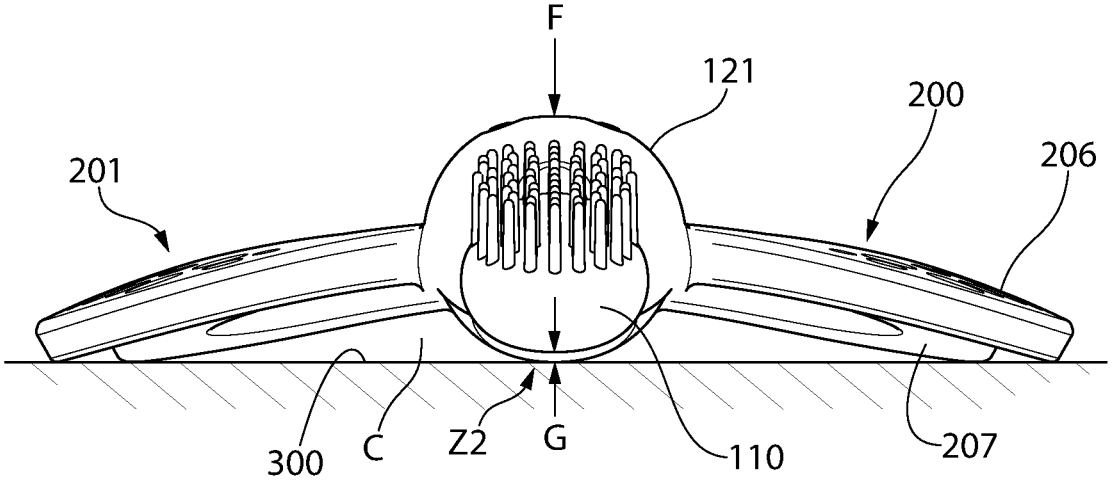
FIG. 10 is a distal end view thereof showing the foldable wings in a deformed position.
Figure 11:
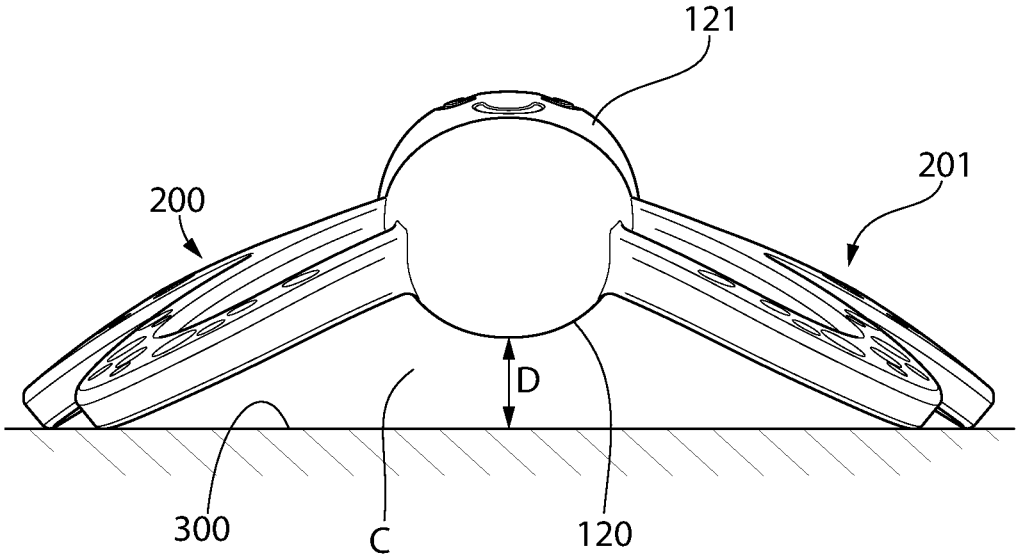
FIG. 11 is a proximal end view of the toothbrush shown in FIG. 6.
Figure 12:
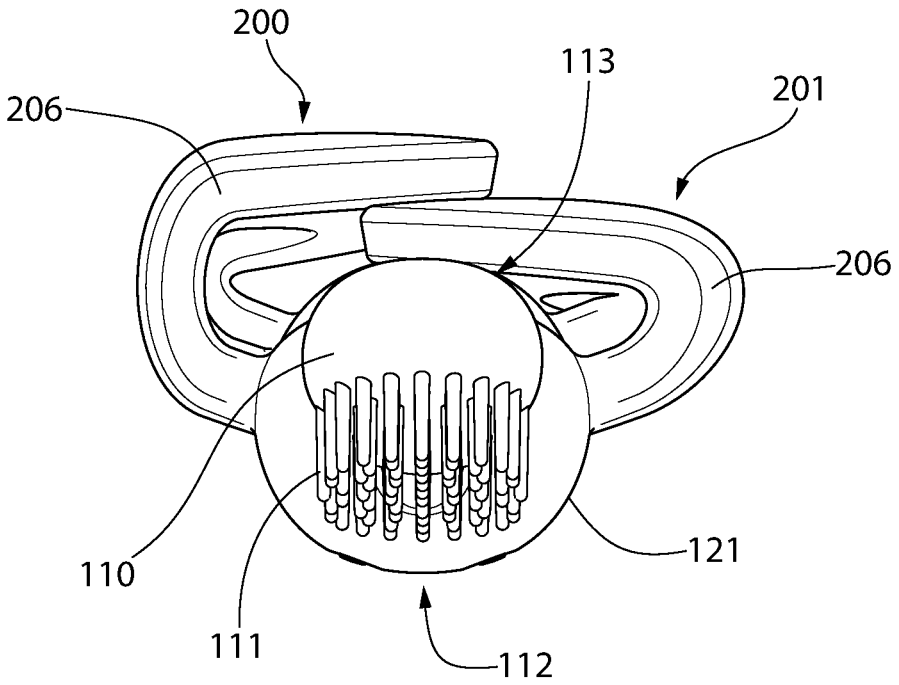
FIG. 12 is a distal end view of the toothbrush of FIG. 1 showing the wings in a deformed and folded position.

Referring to FIGS. 8 and 9, wings 200, 201 may further be arcuately curved in a lateral/transverse direction defining a convex front surface 210 from side to side, and a corresponding concave rear surface 211. The wings define a thickness T1 measured between the front and rear surfaces 210, 211. Thickness T1 may be less than the width W2 measured across the front or rear surfaces of each loop 206, 207 between the exterior peripheral free edge 205 and opposing interior captive edge 208 (see, e.g. FIG. 3), and substantially less than the lateral width W1 measured from the central body to the outermost peripheral free edge 205 of each loop. Because the wings 200, 201 have the smallest cross section in the front to rear direction, this structurally increases flexibility in that same direction to facilitate bending the wings forward or rearward for reasons further described herein.

The wings 200, 201 may each be obliquely angled at an angle A1 to a horizontal reference plane HP that intersects the longitudinal axis A-A and extends transversely through the first and second lateral sides 114 of the central body of the handle portion 101 (see, e.g. FIG. 8). A vertical reference plane VP is defined that intersects longitudinal axis A-A and is normal to horizontal reference plane HP. Wings 200, 201 may be arranged at an angle A2 between and towards each other. This oriented and biases the wings in a direction predisposed towards the rear side 113 of the central body as shown. The wings are thus rearwardly swept or angled in one configuration. Angle A2 may be an obtuse angle acute angle between 90 and 180 degrees. In one embodiment, angle A2 may be about 130 degrees as a non-limiting example. Each wing 200, 201 is angled at an acute angle A4 to vertical reference plane VP. Angles A2 and A4 may be measured to the rear surface of each wing at approximately the midpoint measured between the central body and the free edge 205.

Wings 200 and 201 comprise the same resilient material of the central body having an elastic memory. The wings 200, 201 are resiliently deformable and movable between a laterally extended outward or unfolded position (see, e.g. FIG. 9) and an inward folded position collapsed against the rear side 113 of central body of handle portion 101 of the toothbrush (see, e.g. FIG. 12). Normally, the wings 200 and 201 have width W1 that when combined with the width of the central body is selected to preclude over-insertion of the toothbrush 100 into the oral cavity from either the distal or proximal ends 102, 103 when the wings are in the outward unfolded position. This is intended to prevent or minimize exposure to a potential choking hazard. To further prevent over-insertion, the head portion 110 and/or opposing proximal end 103 portion of the handle portion 101 may have a maximum projection axially along longitudinal axis A-A of no more than about 1 inch or less.

To facilitate an adult to reach teeth deeper in the oral cavity with toothbrush 100 for cleansing, the wings 200, 201 may be folded inward over and onto the rear side 113 of the central body in which the wings overlap each other. This narrows the lateral profile of the toothbrush making access deeper into the oral cavity easier. When released, the wings will spring back to and return to their undeformed and unfolded outward position. The wings 200 and 201 may have sufficient flexibility to also be folded over onto the front side 112 of the central body of handle portion 101 if desired.

In conjunction with the central body of handle portion 101, the configuration and orientation of the rearward-swept lateral wings 200, 201 is designed to help maintain a sterile toothbrush head when the brush is dropped or laid down on a flat horizontal surface during use, such as for example a sink vanity countertop or the floor. FIGS. 5-12 show various positions and orientations of the toothbrush 100 engaging a flat and hard horizontal surface 300. The central body of handle portion 101 and wings 200, 201 are collectively designed and configured such that the head portion 110 and tooth cleaning elements 111 preferably do not contact the horizontal surface under normal circumstances.

FIGS. 6 and 9-11 show the toothbrush in a face up position laid on surface 300 with the tooth cleaning elements 111 facing away from surface (i.e. upwards). The outermost peripheral free edges 205 of each loop 206, 207 of wings 200, 201 abuttingly contact surface 300. The wings are in the unfolded or extended position. The peripheral free edges 205 of each of the two upper loops 206 define a pair of laterally spaced apart first contact zones Z1, and peripheral free edges 205 of each of the two lower loops 207 define a pair of laterally spaced apart second contact zones Z2. Contact zones Z1 and Z2 define a common rear support plane S1 which becomes coplanar with surface 300 when the toothbrush is placed thereon. It bears noting that no part of support plane S1 intersects any portion of head portion 110 including tooth cleaning elements 111. Contact zones Z1 and Z2 are spatially discrete contact zones which may each comprise a point contact or area contact surface over a broader portion of the wings than a single point. Although two discrete spatially separated contact zones Z1 and Z2 have been described, it will be appreciated that in other possible embodiments a single contact zone may instead be provided depending on the shape and contours of the wings 200, 201.

With continuing reference to FIGS. 6 and 9-11, the arched profile of toothbrush 100 from side to side created by wings 200, 201 raises and elevates the central body of handle portion 101 above the surface 300. This forms a bridge spanning over the surface that supports the central body in a suspended manner. A cavity C is formed between the rear sides of the wings and central body; the latter central body being spaced apart from horizontal surface 300 by a distance D. In particular, a gap G is formed between the head portion 110 of the central body so that the head does not contact the surface and become contaminated by residual bacteria that may present thereon. Accordingly, no portion of the central body (i.e. distal portion 121 or proximal portion 120) engages surface 300. Cavity C extends for the entire longitudinal length of the toothbrush 100 which raises the entire central body off of surface 300.

Even in the event that a user applies a reasonable downward force F on the toothbrush and presses the distal or proximal portions 121, 120 against the surface 300 (see, e.g. FIG. 10), the head portion 110 will still be elevated to maintain gap G therebetween (albeit a smaller gap than seen in FIG. 9). The bulbous spherically shaped distal portion 121 of the central body which protrudes beyond the rear side of the proximal portion 120 acts as a fulcrum to raise the head portion 110 above the surface 300. It will be noted that the wings 200, 201 assume a more flattened position or condition in FIG. 10 under application of force F.

Figure 5:
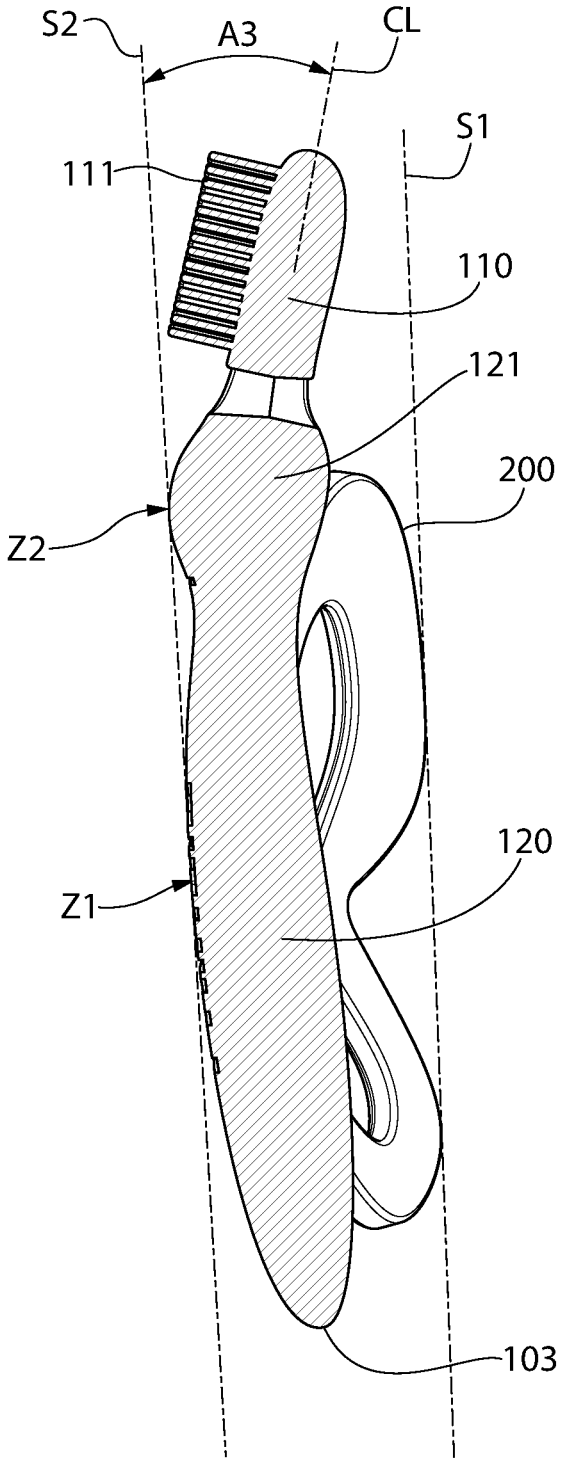
FIG. 5 is a side cross-sectional view thereof.
Figure 6:
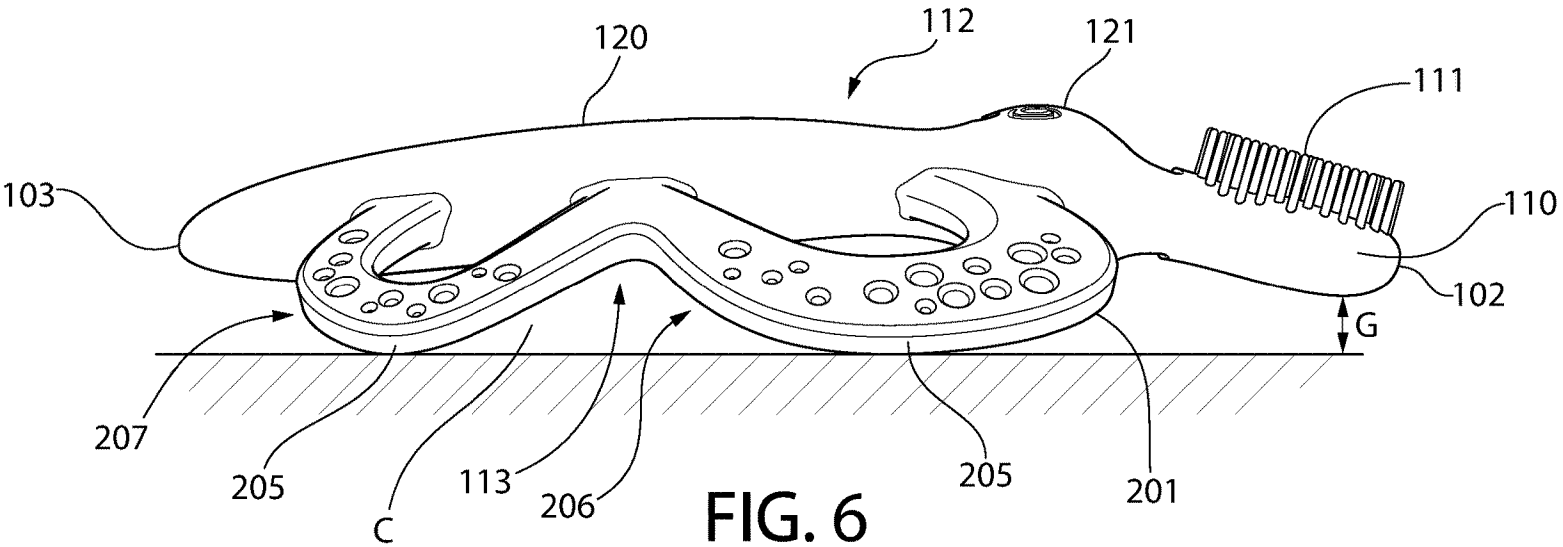
FIG. 6 is a side view showing the toothbrush in a first position and orientation on a horizontal surface with wings in an undeformed position.
Figure 7:
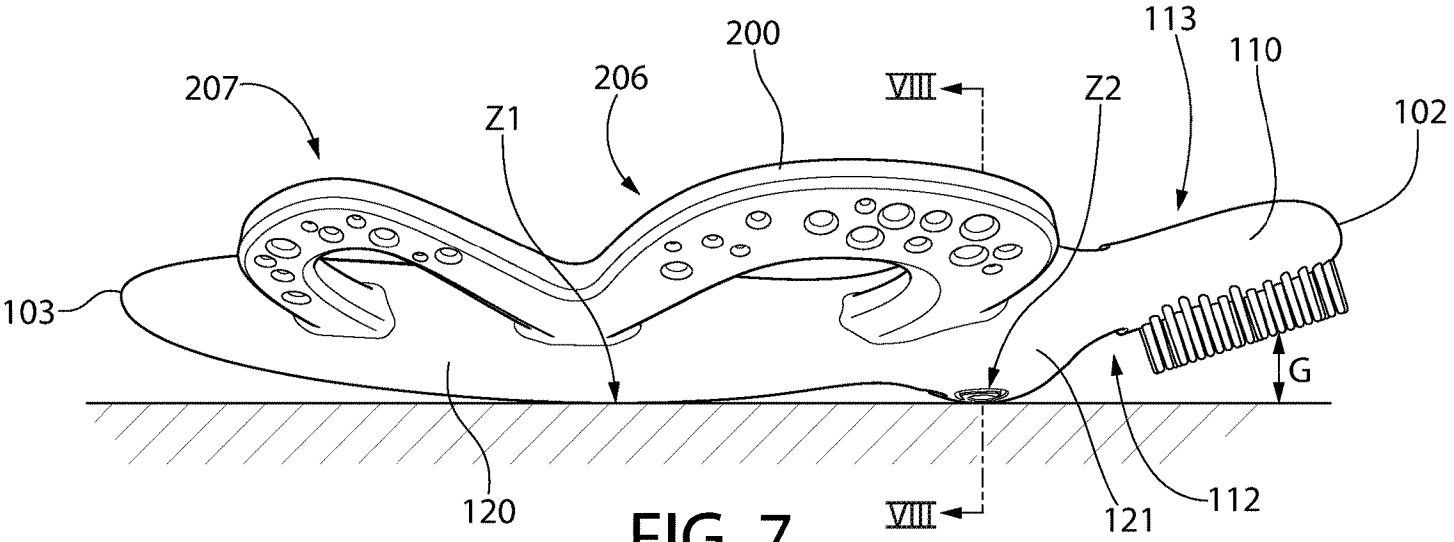
FIG. 7 is a side view thereof showing the toothbrush in a second position and orientation on the horizontal surface.

By contrast, FIGS. 5, 7, and 8 show the toothbrush 100 laid in a face down position on surface 300 with the tooth cleaning elements 111 facing towards the surface (i.e. downwards). In this position, the end to end arched shape of the central body of handle portion 101 and bulbous spherical shape of the distal portion 121 define a third contact zone Z3 on the front side of the central body and a fourth contact zone Z4 on front side of the distal portion. Contact zones Z3 and Z4 are spatially discrete contact zones which may each comprise a point contact or area contact surface over a broader portion of the wings than a single point. Contact zones Z3 and Z4 define a common front support plane S2 which becomes coplanar with surface 300 when the toothbrush is placed thereon. It bears noting that no part of support plane S2 intersects any portion of head portion 110 including tooth cleaning elements 111. Head portion 110 may be obliquely angled to support plane S2 passing through the contact zones Z3, Z4 thus defining an oblique angle A3 between plane S2 and the centerline CL of the head portion 110 (see, e.g. FIG. 5). When toothbrush 100 is laid on horizontal surface 300, the central body of the toothbrush only contacts the horizontal surface 300 at the contact zones Z3 and Z4. The obliquely angled head portion 110 (including tooth cleaning elements 111) is elevated above surface 300 by gap G to maintain the sterility of the head. The bulbous spherically shaped distal portion 121 which protrudes beyond the front side of the proximal portion 120 of handle portion 101 acts again as a fulcrum to raise the head portion 110 above the surface 300. It will be noted that a space is created between the narrow neck section 122 of the central body and the surface 300 attributable to the bulbous distal portion. The proximal end 103 of the central body on proximal portion 120 of the handle portion 101 is also raised off of the surface due to the arcuate or arched contour of the proximal portion 120 from proximal end 103 to the end joined with the distal portion 121. Although two discrete spatially separated contact zones Z3 and Z4 have been described, it will be appreciated that in other possible embodiments a single contact zone may instead be provided depending on the shape and contours of the central body of the handle portion 101.

In one embodiment, the radius of curvature of the front surface of the proximal and distal portions 120, 121 on the front side 112 at contact zones Z3 and Z4 are selected to be large enough to create a more flattened, albeit still convexly rounded profile that may maintain a balanced position as best shown in FIG. 8 when the toothbrush is randomly placed on surface 300. In the event that the toothbrush 100 is tilted to the right or left side so that one of the wings 200 or 201 engages the surface as well, the toothbrush is dynamically balanced such that the toothbrush will automatically roll back to the centered position shown when released by the user.

Figure 13:
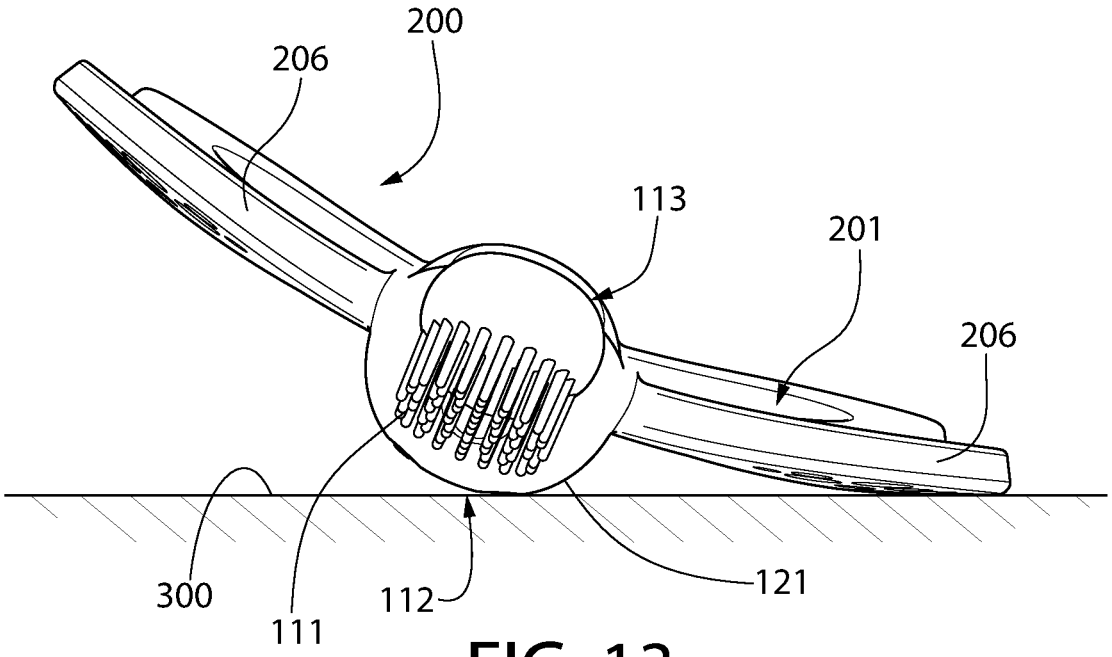
FIG. 13 is a distal end view of the toothbrush showing an over-rotation prevention feature.

Wings 200 and 201 also function to prevent over-rotation of the toothbrush 100 when placed face down on surface 300. As shown in FIG. 13, if the toothbrush 100 becomes unbalanced when laid on the horizontal surface 300 in a random manner, the peripheral free edges 205 of one of the wings will contact surface 300 to prevent further rotation and prevent contact between the toothbrush head portion 110 and tooth cleaning elements 111 thereon. The toothbrush 100 will tend to roll back towards a centered position (see, e.g. FIG. 8) due to the counter-weight balancing effect created by the wing on the opposing side not in contact with the surface 300.

In one embodiment, the toothbrush 100 may be made aesthetically interesting in appearance and configuration for younger users. In the non-limiting illustrated embodiment, the toothbrush may be configured to resemble an animate object such as insects, animals, reptiles, or other. The invention is not so limited, however, and the toothbrush 100 may have any configuration which may be associated with inanimate objects, characters, or completely random including various combinations of artistically creative and whimsical shapes. Toothbrush 100 may include various printed, embossed, and/or recessed surface indicia 230 indicative of the animate or inanimate object intended to be portrayed.

Figure 14:
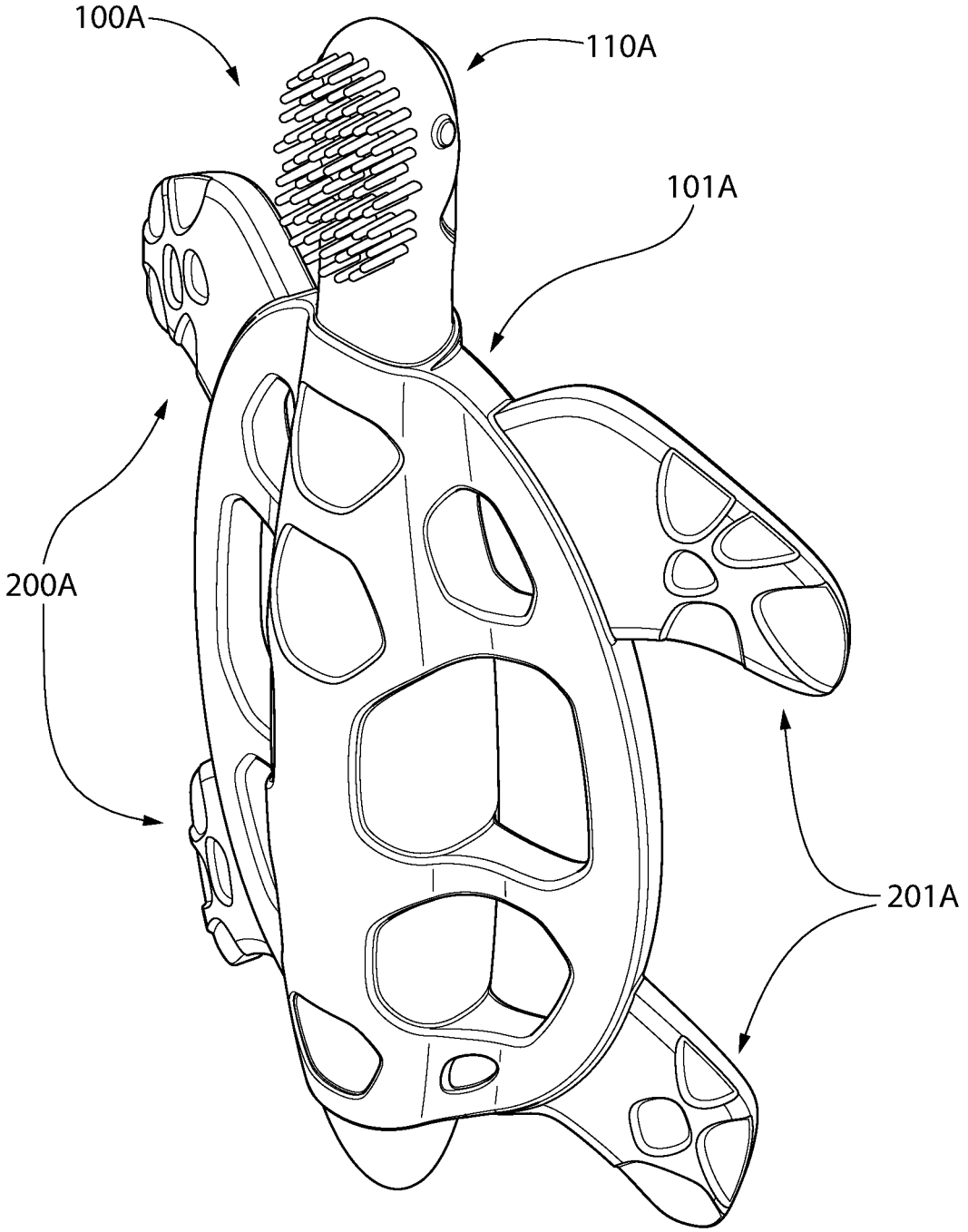
FIG. 14 is a front perspective view of a first alternative embodiment of a toothbrush generally including a head portion and handle portion having a central body and foldable appendages shown in an unfolded position.
Figure 15:
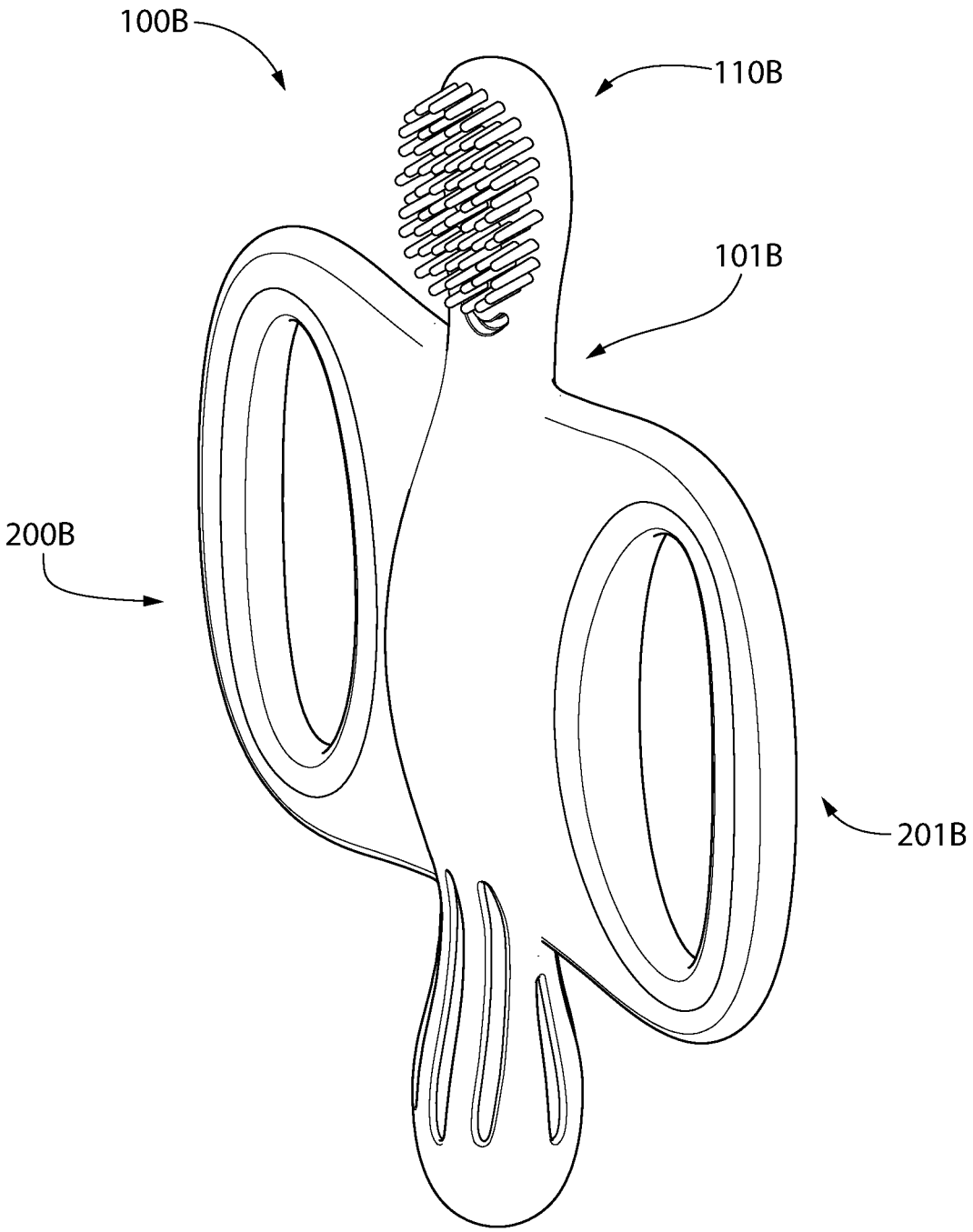
FIG. 15 is a front perspective view of a second alternative embodiment of a toothbrush generally including a head portion and handle portion having a central body and foldable appendages shown in an unfolded position.

In view of the foregoing, it will be appreciated that virtually limitless shapes or configurations are of course possible for toothbrush 100. To illustrate this point, FIGS. 14 and 15 depict different examples of some possible alternate configurations of toothbrush 100 having uniquely shaped handle portions. FIG. 14 depicts a toothbrush 100A having head portion 110A, handle portion 101A, and appendages 200A, 201A which collectively resemble a turtle. FIG. 15 depicts a toothbrush 100B having head portion 110B, handle portion 101B, and appendages 200B, 201B which collectively resemble a whimsical character or shape. Toothbrushes 100A and 100B include the same features and function previously described herein for toothbrush 100 including provisions to prevent over-insertion into the oral cavity/mouth and reduce bacterial contamination transfer from hard surfaces when the toothbrush is placed or dropped thereon. They will not be repeated here for the sake of brevity.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. An oral care implement comprising:

a head portion comprising a plurality of tooth cleaning elements;

a handle portion coupled to the head portion, the handle portion comprising:

a central body comprising a proximal portion opposite the head portion;

a first appendage extending laterally outwards from a first side of the central body in a first direction; and a second appendage extending laterally outwards from a second side of the central body in a second direction opposite to the first direction, the first and second appendages being angled towards each other to form an obtuse angle therebetween when in an unstressed state;

wherein the proximal portion of the central body protrudes from a bottom end of the first and second appendages; and wherein the first and second appendages are formed of a material having an elastic memory, the elastic memory material returning the first and second appendages to a first position after being releasably manipulated from the first position to a second position.

2. The oral care implement according to claim 1, wherein the first position is an unfolded position of the first and second appendages and the second position is an inward folded position of the first and second appendages.

3. The oral care implement according to claim 1, wherein the head portion, handle portion, appendages, and tooth cleaning elements are molded as a monolithic unitary structure formed of a same material.

4. The oral care implement according to claim 3, wherein the head portion, handle portion, appendages, and tooth cleaning elements are formed of a resiliently deformable silicone rubber having a durometer hardness value in a range between and including 60-70.

5. The oral care implement according to claim 1, wherein the head portion comprises a single distal end comprising the plurality of tooth cleaning elements.

6. The oral care implement according to claim 1, wherein the first and second appendages each comprise a pair of recurvant loop structures having a pair of opposing ends coupled to the central body of the oral care implement.

7. The oral care implement according to claim 1, wherein each of the first and second appendages have an arcuate transverse cross-sectional configuration that is rearwardly angled forming the obtuse angle therebetween.

8. An oral care implement comprising:

a head portion comprising a plurality of tooth cleaning elements; and a handle portion coupled to the head portion, the handle portion comprising:

a central body;

a front side comprising a first point of contact to a surface and a second point of contact to the surface, the first and second points of contact defining a front support plane that is coplanar with the surface;

a contoured portion separating the first and second points of contact, the front support plane not intersecting the contoured portion;

a first appendage extending outwards from a first lateral side of the central body in a first direction; and a second appendage extending outwards from a second lateral side of the central body in a second direction; and wherein the head portion is obliquely angled to the front support plane such that the head portion extends from the handle portion in a direction away from the front support plane.

9. The oral care implement according to claim 8, wherein the central body comprises a bulbous spherically shaped distal portion defining the first point of contact and an arch shaped proximate portion defining the second point of contact.

10. The oral care implement according to claim 9, wherein the bulbous spherically shaped distal portion of the central body defines a lateral width greater than a lateral width of the head portion.

11. The oral care implement according to claim 9, wherein when the oral care implement is placed on the surface with the tooth cleaning elements facing towards the surface, the bulbous spherically shaped distal portion of the central body engages the surface and elevates the head portion and the tooth cleaning elements above the surface.

12. The oral care implement according to claim 8, wherein the first and second appendages are formed of a material having an elastic memory, the elastic memory material returning the first and second appendages to an unfolded position after being releasably manipulated from the unfolded position to an inward folded position.

13. The oral care implement according to claim 8, wherein the head portion, handle portion, appendages, and tooth cleaning elements are molded as a monolithic unitary structure formed of a same material.

14. An oral care implement comprising:

a head portion comprising a plurality of tooth cleaning elements; and a handle portion coupled to the head portion, the handle portion comprising:

a central body comprising a bulbous spherically shaped distal portion and an arch shaped proximate portion, the bulbous spherically shaped distal portion and the arch shaped proximate portion defining a respective first point of contact to a surface and a second point of contact to the surface, the first and second points of contact defining a front support plane that is coplanar with the surface;

a first appendage extending outwards from a first lateral side of the central body in a first direction; and a second appendage extending outwards from a second lateral side of the central body in a second direction; and wherein the first and second appendages each comprise a pair of recurvant loop structures having a pair of opposing ends coupled to the central body.

15. The oral care implement of claim 14, wherein the first point of contact defines a first curvature having a first radius and the second point of contact defines a second curvature having a second radius, the radiuses of the first and second curvatures defining flattened surfaces.

16. The oral care implement according to claim 14, wherein when the oral care implement is placed on the surface with the tooth cleaning elements facing towards the surface and tilted to a side of the first appendage or second appendage, at least one of the first appendage or the second appendage prevents the oral care implement from being rolled to a rear side of the central body.

17. The oral care implement according to claim 14, wherein when the oral care implement is placed on the surface with the tooth cleaning elements facing towards the surface, the bulbous spherically shaped distal portion of the central body engages the surface and elevates the head portion and the tooth cleaning elements above the horizontal surface.

18. The oral care implement according to claim 14, wherein the head portion, handle portion, appendages, and tooth cleaning elements are molded as a monolithic unitary structure formed of a same material.

* * * * *